US010612429B1

(12) United States Patent
Shamie et al.

(10) Patent No.: US 10,612,429 B1
(45) Date of Patent: Apr. 7, 2020

(54) COUPLING FOR A CAMSHAFT PHASER ARRANGEMENT FOR A CONCENTRIC CAMSHAFT ASSEMBLY

(71) Applicants: Christopher Shamie, Brighton, MI (US); Michael Kandolf, Saint Clair, MI (US)

(72) Inventors: Christopher Shamie, Brighton, MI (US); Michael Kandolf, Saint Clair, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/193,122

(22) Filed: Nov. 16, 2018

(51) Int. Cl.
*F01L 1/34* (2006.01)
*F01L 1/344* (2006.01)

(52) U.S. Cl.
CPC ..... *F01L 1/34413* (2013.01); *F01L 1/3442* (2013.01); *F01L 2001/34496* (2013.01)

(58) Field of Classification Search
CPC ..... F01L 1/3442; F01L 1/047; F01L 1/026; F01L 1/352; F01L 1/022; F01L 1/024; F01L 1/053; F01L 1/34413; F01L 2001/34493; F01L 2001/0473; F01L 2001/0535; F01L 2001/34489; F01L 2001/3521; F01L 2001/34496; F01L 2820/041; F01L 2820/032
See application file for complete search history.

(56) References Cited

U.S. PATENT DOCUMENTS

| | | | | |
|---|---|---|---|---|
| 6,725,817 | B2 | 4/2004 | Methley et al. | |
| 7,841,311 | B2 | 11/2010 | Hutcheson et al. | |
| 8,051,818 | B2 | 11/2011 | Myers et al. | |
| 8,191,521 | B2 | 6/2012 | Kandolf et al. | |
| 8,201,528 | B2 | 6/2012 | Knecht et al. | |
| 8,371,257 | B2 * | 2/2013 | Moon | F01L 1/3442 123/90.15 |
| 8,887,676 | B2 | 11/2014 | Methley et al. | |
| 9,080,474 | B2 | 7/2015 | Wigsten et al. | |
| 9,366,159 | B2 | 6/2016 | Wigsten et al. | |
| 2010/0089353 | A1 | 4/2010 | Myers et al. | |
| 2010/0186698 | A1 | 7/2010 | Pluta | |
| 2018/0274400 | A1 | 9/2018 | Berwinkl et al. | |

FOREIGN PATENT DOCUMENTS

| | | | |
|---|---|---|---|
| DE | 102009041755 | A1 | 4/2010 |
| DE | 102014212615 | A1 | 12/2015 |
| WO | 2017/042302 | A1 | 3/2017 |

* cited by examiner

*Primary Examiner* — Zelalem Eshete
(74) *Attorney, Agent, or Firm* — Matthew V. Evans

(57) ABSTRACT

A camshaft phaser arrangement configured for a concentric camshaft assembly having inner and outer camshafts is provided. The camshaft phaser arrangement includes a first camshaft phaser, a second camshaft phaser, and a coupling that torsionally connects the first camshaft phaser to the second camshaft phaser. Each of the camshaft phasers is configured to be connected to either the inner or the outer camshaft. The coupling includes at least one flexible connector that provides for radial and axial movement between the first camshaft phaser and the second camshaft phaser.

20 Claims, 4 Drawing Sheets

COUPLING FOR A CAMSHAFT PHASER ARRANGEMENT FOR A CONCENTRIC CAMSHAFT ASSEMBLY

TECHNICAL FIELD

Example aspects described herein relate to couplings for camshaft phasers, and, more particularly, to camshaft phasers utilized within an internal combustion (IC) engine having a concentric camshaft assembly.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator to achieve variable engine valve timing. Electric camshaft phasers can be configured with a gearbox and an electric motor to phase a camshaft to achieve variable engine valve timing.

Many different camshaft configurations are possible within an IC engine. Some camshaft configurations include an intake camshaft that only actuates intake valves, and an exhaust camshaft that only actuates exhaust valves; such camshaft configurations can often simplify efforts to independently phase the intake valve events separately from the exhaust valve events. Other camshaft configurations can utilize a single camshaft to actuate both intake and exhaust valves; however, a single camshaft configured with both intake and exhaust lobes proves difficult to provide independent phasing of the intake and exhaust valves. For single camshaft configurations, a concentric camshaft assembly can be implemented that utilizes an inner camshaft and an outer camshaft, each arranged with one of either exhaust lobes or intake lobes, with each of the camshafts having a designated camshaft phaser to vary the respective engine valve timing.

One known camshaft phaser arrangement for a concentric camshaft assembly includes a first and a second camshaft phaser that are stacked coaxially at an end of the concentric camshaft assembly. A solution is needed that facilitates connection of this camshaft phaser arrangement to the concentric camshaft assembly while torsionally or rotationally coupling the two camshaft phasers to a crankshaft of the IC engine.

SUMMARY

A camshaft phaser arrangement configured for a concentric camshaft assembly having inner and outer camshafts is provided. The camshaft phaser arrangement includes a first camshaft phaser, a second camshaft phaser, and a coupling arranged to torsionally connect the first camshaft phaser to the second camshaft phaser. Each of the camshaft phasers is configured to be connected to one of either the inner or the outer camshaft. The coupling includes at least one flexible connector that has a first connection to one of the first or second camshaft phaser and a second connection to the other of the first or second camshaft phaser. The at least one flexible connector is configured to provide for radial movement and axial movement between the first and second camshaft phasers. The at least one flexible connector can deflect laterally to provide for axial movement of at least one of the first camshaft phaser or the second camshaft phaser.

Stated more precisely, the at least one flexible connector can deflect laterally to provide for axial movement of either one or both of the first camshaft phaser and the second camshaft phaser.

The at least one flexible connector can be arc-shaped or curved, having any desirable angular span. In one example embodiment, the angular span ranges between 1 and 359 degrees.

The at least one flexible connector can be configured with a first aperture at a first end, facilitating the first connection to one of either the first or second camshaft phaser, and a second aperture at a second end, facilitating the second connection to the other of the first or second camshaft phaser. The first aperture can receive a first fastener to further facilitate the first connection, and the second aperture can receive a second fastener to further facilitate the second connection. The second aperture can be a slotted hole to provide for radial movement between the first and second camshaft phasers. A pathway for the radial movement can be defined by the slotted hole.

The first or second connection of the at least one flexible connector can be facilitated by at least one axial extension that has a first end that connects to the at least one flexible connector and a second end that connects to either the first or second camshaft phaser. In one example embodiment, the second end of the axial extension is connected to the second camshaft phaser, the first camshaft phaser arranged axially outward of the second camshaft phaser. In another example embodiment, a first end of the at least one flexible connector is connected to the first camshaft phaser, and a second end of the at least one flexible connector is connected to the second camshaft phaser, the first camshaft phaser arranged axially outward of the second camshaft phaser. In one aspect, the first end of the at least one flexible connector is connected to a non-phased component of the first camshaft phaser, and the second end of the at least one flexible connector is connected to a non-phased component of the second camshaft phaser. In an instance where the first camshaft phaser is an electric camshaft phaser and the second camshaft phaser is a hydraulic camshaft phaser, the first end of the at least one flexible connector can be connected to an outer collar of the first camshaft phaser and a second end of the at least flexible connector can be connected to a stator of the second camshaft phaser.

At least one of the first or second camshaft phaser can be an electric camshaft phaser or a hydraulic camshaft phaser. Furthermore, the first camshaft phaser can be an electric camshaft phaser that is configured to be connected to the inner camshaft, and the second camshaft phaser can be a hydraulic camshaft phaser configured to be connected to the outer camshaft.

The second camshaft phaser can include a drive wheel that is configured with a powertrain interface.

A coupling configured to torsionally connect a first camshaft phaser to a second camshaft phaser is provided. The first and second camshaft phaser are arranged to provide phasing for a concentric camshaft assembly. The coupling includes at least one flexible connector with a first end configured to connect with a first camshaft phaser and a second end configured to connect with a second camshaft phaser. The at least one flexible connector is configured to provide for radial movement and axial movement between the first camshaft phaser and the second camshaft phaser.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
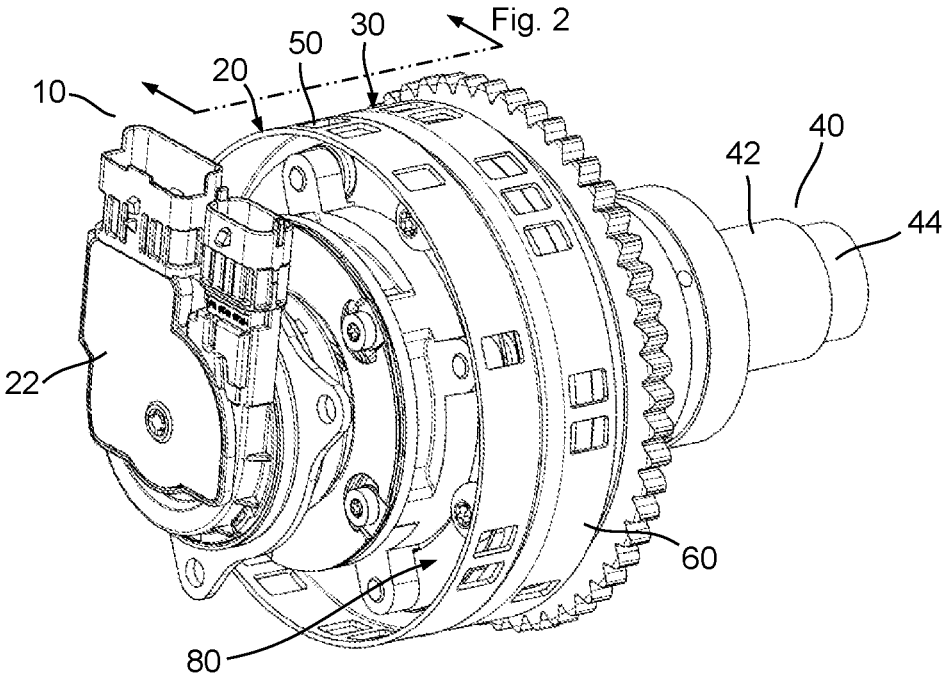
FIG. 1 is a perspective view of a camshaft phaser arrangement for a concentric camshaft assembly that includes a coupling that torsionally connects a first camshaft phaser to a second camshaft phaser.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
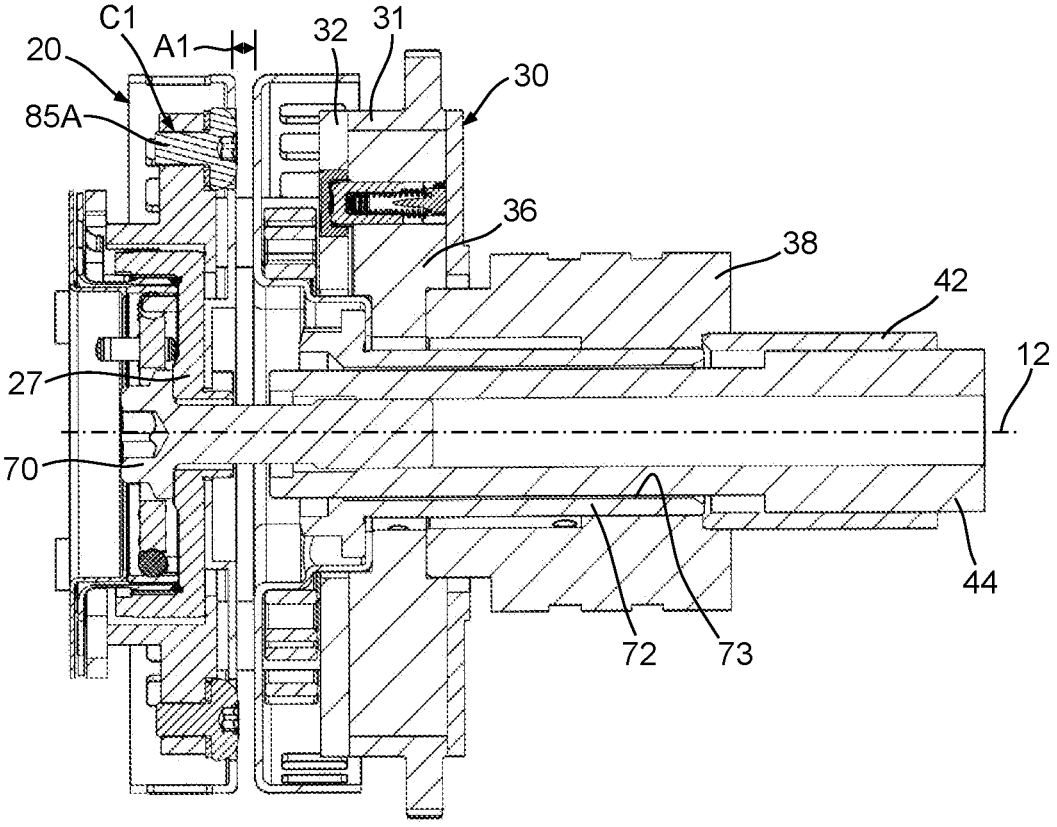
FIG. 2 is a cross-sectional view taken from FIG. 1.
Figure 3:
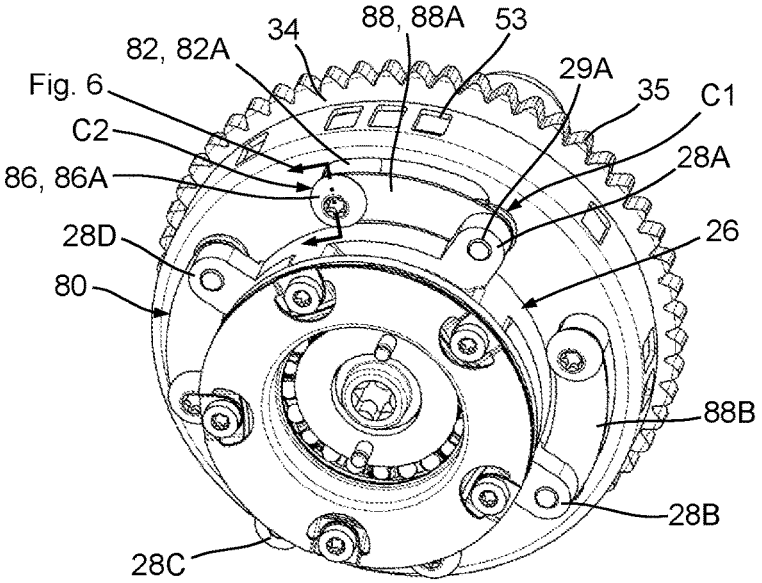
FIG. 3 is a perspective view of the camshaft phaser arrangement of FIG. 1 with some components removed to show the coupling that torsionally connects the first camshaft phaser to the second camshaft phaser.
Figure 4:
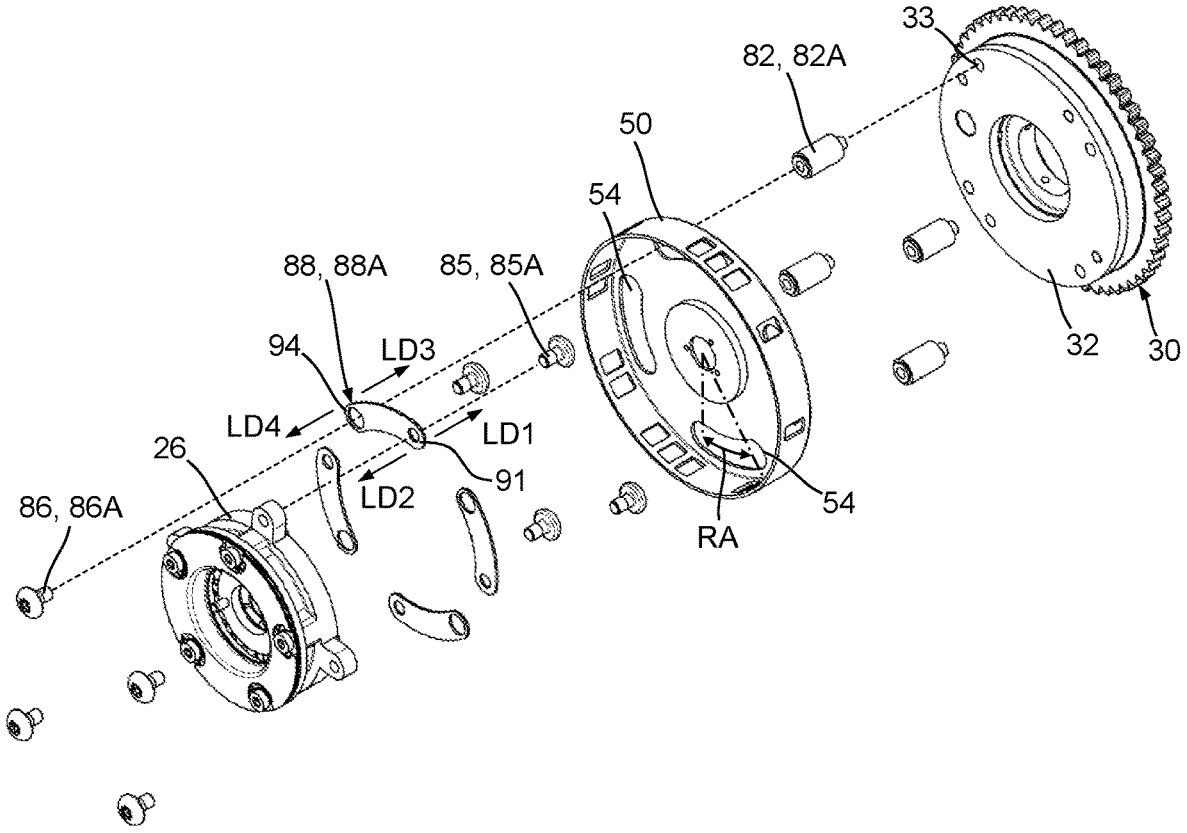
FIG. 4 is an exploded perspective view of the camshaft phaser arrangement of FIG. 1 with some components removed to show the coupling that torsionally connects the first camshaft phaser to the second camshaft phaser.

Referring to FIG. 1, a perspective view of an example embodiment of a camshaft phaser arrangement 10 configured for a concentric camshaft assembly 40 is shown that includes a coupling 80 that torsionally connects a first camshaft phaser 20 to a second camshaft phaser 30. FIG. 2 shows a cross-sectional view taken from FIG. 1. FIG. 3 shows a perspective view of the camshaft phaser arrangement 10 of FIG. 1 with an electric motor 22 and a first timing wheel 50 removed to further show the coupling 80. FIG. 4 shows an exploded perspective view of the camshaft phaser arrangement of FIG. 1 with the electric motor 22 and a second timing wheel 60 removed to clearly show the coupling 80 and its components. The following discussion should be read in light of FIGS. 1 through 4. The camshaft phaser arrangement 10 includes a rotational axis 12, the first camshaft phaser 20, the second camshaft phaser 30, the first timing wheel 50, the second timing wheel 60, and the coupling 80 that torsionally couples the two camshaft phasers 20, 30. The first camshaft phaser 20 is arranged axially adjacent to the second camshaft phaser 30 such that the first camshaft phaser 20 is axially outward of the second camshaft phaser 30. Additionally, the first camshaft phaser 20 can be concentric with the second camshaft phaser 30, as shown. The concentric camshaft assembly 40 includes an outer camshaft 42 and an inner camshaft 44. The first camshaft phaser 20 is an electric camshaft phaser, actuated by an electric motor 22, and the second camshaft phaser 30 is hydraulically actuated; however, the first and second camshaft phasers 20, 30 could both either be electric camshaft phasers or hydraulic camshaft phasers; furthermore, the positions of the first and second camshaft phasers 20, 30 could be swapped, such that the second camshaft phaser 30 (hydraulic) is axially outward of the first camshaft phaser 20 (electric).

For the example embodiment shown in FIGS. 1 through 4, the first camshaft phaser 20 is connected to the inner camshaft 44 by a first camshaft fastener 70, and the second camshaft phaser 30 is connected to the outer camshaft 42 by a second camshaft fastener 72. More specifically, the first camshaft fastener 70 connects an output gear 27 of the first camshaft phaser 20 to the inner camshaft 44, and the second camshaft fastener 72 axially clamps a rotor 36 of the second camshaft phaser 30 to a journal bearing 38 that is connected to the outer camshaft 42. The second camshaft fastener 72 has a longitudinal through-aperture 73 through which the inner camshaft 44 extends to facilitate connection with the first camshaft fastener 70. Therefore, the through-aperture 73 encloses a portion of the inner camshaft 44. It could also be possible to connect the inner camshaft 44 to the second camshaft phaser 30 and the outer camshaft 42 to the first camshaft phaser 20.

The coupling 80 includes axial extensions 82, outer phaser fasteners 85, inner phaser fasteners 86, and an arrangement of flexible connectors 88. While the figures show four flexible connectors 88A-88D, any number of flexible connectors 88 could be possible, including one. This is also true of the first outer phaser fasteners 85, the second inner phaser fasteners 86, and the axial extensions 82; while the figures show four of each of these components, any number is possible, including one. The coupling 80 can serve to torsionally couple the first and second camshaft phasers 20, 30, while permitting or providing for axial and radial movement between them. Given that the first camshaft phaser 20 is rigidly mounted to the inner camshaft 44, resultant axial and radial locations of the first camshaft phaser 20 vary due to manufacturing tolerances of several components, including, but not limited to the first camshaft phaser 20, the outer camshaft 42, the concentric camshaft assembly 40, and a housing (not shown), such as a cylinder head of an IC engine, that receives the concentric camshaft assembly 40. Furthermore, rigid mounting of the second camshaft phaser 30 to the outer camshaft 42, combined with component manufacturing tolerances, also varies the axial and radial locations of the second camshaft phaser 30.

In the example embodiment shown in FIGS. 1 through 4, the second camshaft phaser 30 includes a drive wheel 34 with a power transmission interface 35. The power transmission interface 35 can engage with either a belt, chain, gear or any power transmission component that connects the camshaft phaser arrangement 10 to a crankshaft (not shown) or any other power source within an IC engine.

The coupling 80 facilitates a torsional connection between the drive wheel 34 and the first camshaft phaser 20. Stated more specifically, the coupling 80 facilitates a torsional connection between a stator 31 that is connected to the drive wheel 34 and an outer collar 26 of the first camshaft phaser 20. Both the stator 31 and the outer collar 26 can be classified as "non-phased" components that rotate in-phase or in unison with the drive wheel 34.

The flexible connectors 88 are connected to the outer collar 26 by a first connection C1, and to the stator 31 (via a front cover 32) by a second connection C2. The first and second connections C1, C2 will now be described with reference to the first flexible connector 88A shown in FIG. 5A, and a first axial extension 82A shown in FIG. 5B.

Figure 5A:
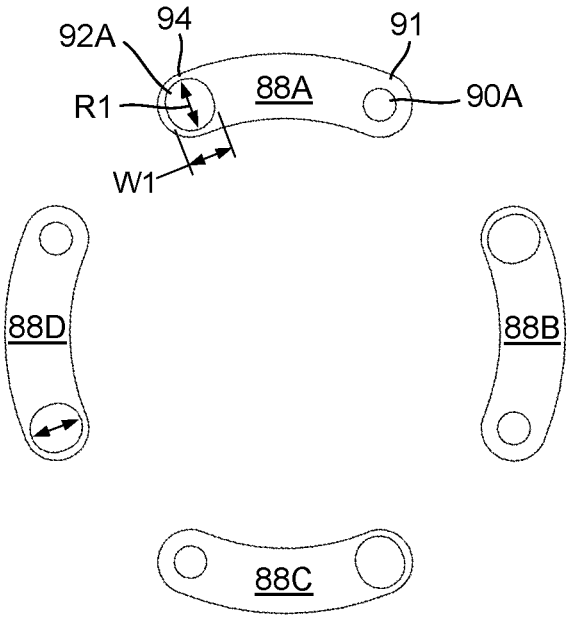
FIG. 5A is a front view of a flexible connector portion of the coupling of FIG. 4.
Figure 5B:
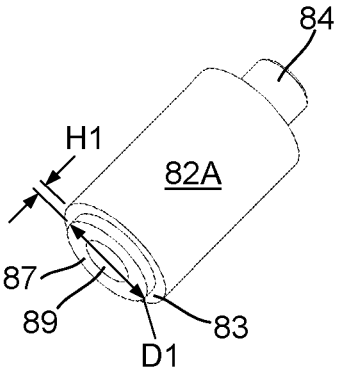
FIG. 5B is an isometric view of an axial extension of the coupling of FIG. 4.
Figure 6:
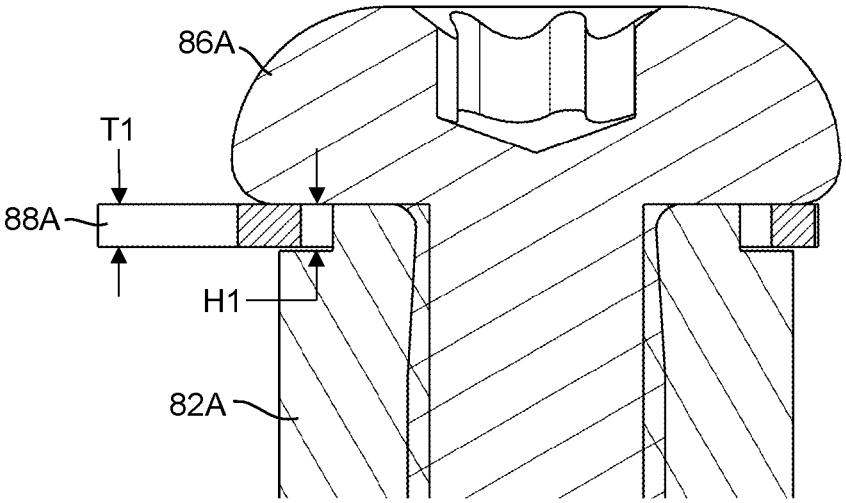
FIG. 6 is a partial cross-sectional view taken from FIG. 3.

For the first connection C1, a first end 91 of the first flexible connector 88A includes a first aperture 90A that receives a first outer phaser fastener 85A to facilitate attachment of the first flexible connector 88A to a threaded aperture 29A of a first protrusion 28A of the outer collar 26. Other fastener types and attachment methods are also possible. Second, third, and fourth protrusions 28B-28D can respectively connect second, third, and fourth flexible connectors 88B-88D (FIG. 5A). The first connection C1 connects the first flexible connector 88A to the outer collar 26, however, the first flexible connector 88A could be attached to any non-phased component of the first camshaft phaser 20.

For the second connection C2, a second end 94 of the first flexible connector 88A includes a second aperture 92A formed as a slotted hole. The second aperture 92A is received by a raised boss 87 at a first end 83 of the first axial extension 82A. A second end 84 of the first axial extension 82A is received by an aperture 33 in the front cover 32; this connection can be facilitated by an interference fit or a threaded fit. A diameter D1 (or width) of the raised boss 87 is smaller than a width W1 of the second aperture 92A. Additionally, a height H1 of the raised boss 87 is greater than a thickness T1 of the second end 94 of the first flexible connector 88A. A first inner phaser fastener 86A is received by a threaded hole 89 at the first end 83 of the first axial extension 82A; thus, the second end 94 of the first flexible connector 88A is slidably retained by the first inner phaser fastener 86A. Since D1 is less than W1 and H1 is greater than T1, the second connection C2 permits or provides for radial movement R1 of the first flexible connector 88A relative to the second camshaft phaser 30. A pathway for the first radial movement R1 is defined by the second aperture 92A.

The flexible connectors 88 are flexible or compliant providing for axial movement A1 of one or both of the first camshaft phaser 20 and the second camshaft phaser 30. Referring to the first flexible connector 88A of FIG. 4, either a first lateral deflection LD1 or a second lateral deflection LD2 of the first end 91 can be possible; furthermore, either a third lateral deflection LD3 or a fourth lateral deflection of the second end 94 can also be possible. Each of the four lateral deflections LD1-LD4 can result from movement of either the first camshaft phaser 20 or second camshaft phaser 30 along the rotational axis 12. In an instance where the first camshaft phaser 20 is not concentric with the second camshaft phaser 30, the first and second lateral deflections LD1, LD2 can be representative of movement of the second camshaft phaser 30 along its rotational axis; and, the third and fourth lateral deflections LD3, LD4 can be representative of movement of the first camshaft phaser 20 along its rotational axis.

As shown in the figures, the flexible connectors 88 can be arc-shaped or curved; however, the flexible connectors 88 can be of any shape that fulfills the purpose of providing radial and axial movement between the first camshaft phaser 20 and the second camshaft phaser 30. An angular span of the arc-shaped flexible connectors 88 could be of any magnitude, yet, in an instance of multiple flexible connectors, the angular span may likely reside between 1 and 180 degrees. Furthermore, in an instance of a single flexible connector, the angular span may likely reside between 1 and 359 degrees.

The coupling 80 fulfills a torsional connection role while permitting or providing for: 1). Axial movement A1 between the first camshaft phaser 20 and the second camshaft phaser 30; and, 2). Radial movement R1 between the first camshaft phaser 20 and the second camshaft phaser 30. The axial movement A1 and the radial movement R1 can not only help endure assembly location variability due to the previously described manufacturing tolerances, but also location variability of the first and second camshaft phasers 20, 30 during use of the IC engine. For example, axial and radial valve train forces that act on the inner camshaft 44 are likely different than axial and radial valve train forces that act on the outer camshaft 42, which can translate to unequal axial and radial movements of the first camshaft phaser 20 and the second camshaft phaser 30 that are connected to these respective components. In addition, a power transmission interface force that is applied to the drive wheel 34 of the second camshaft phaser 30, likely results in a different resultant motion and position of the second camshaft phaser 30 relative to the first camshaft phaser 20.

Referring to FIGS. 1 through 4, a first timing wheel 50 and a second timing wheel 60 are shown. As the first and second timing wheels 50, 60 rotate about the rotational axis 12, sensing windows 53 cooperate with camshaft position sensors (not shown) to provide angular position of the respective inner camshaft 44 and outer camshaft 42 of the concentric camshaft assembly 40. The first and second timing wheels 50, 60 can each have cutouts 54 to provide space for the coupling 80 due to relative phasing that occurs of the outer camshaft 42 and the inner camshaft 44 by the respective first and second camshaft phasers 20, 30. The cutouts 54 have an angular span that can at least accommodate a rotational range of camshaft phaser authority RA for the first and second camshaft phasers 20, 30; the rotational range of authority RA is defined as the additive advance and retard phasing capability, relative to a piston top-dead-center (TDC) position. For example, in an instance where timing of an engine valve can be advanced to a maximum of −40 degrees relative to TDC and retarded to a maximum of +10 degrees relative to TDC, the range of authority is 50 degrees of camshaft rotation. Thus, the cutouts 54 have an angular span that can at least accommodate a range of authority of the first and second camshaft phasers 20, 30.

Figure 7A:
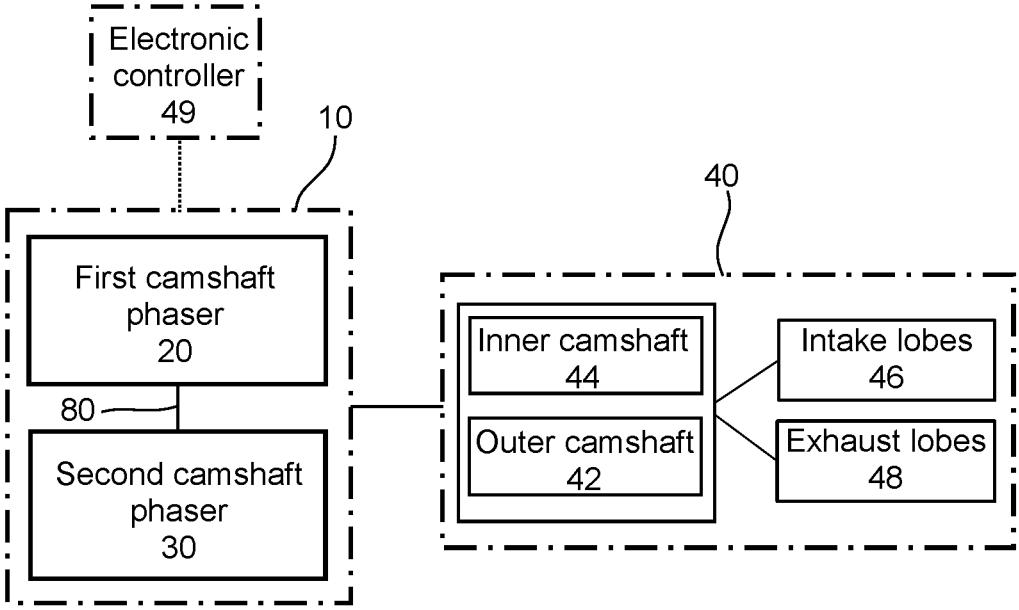
FIG. 7A is a schematic diagram of the camshaft phaser arrangement of FIG. 1 together with an electronic controller, depicting a flexible location of intake and exhaust camshaft lobes within the concentric camshaft assembly.

The camshaft phaser arrangement 10 for the concentric camshaft assembly 40 provides independent phasing of the inner camshaft 44 relative to the outer camshaft 42. Referring to FIG. 7A, a schematic diagram of the camshaft phaser arrangement 10 is shown together with an electronic controller 49, and the concentric camshaft assembly 40. The camshaft phaser arrangement 10 can be controlled by the electronic controller 49; this electronic controller 49 can possibly be an electronic control unit (ECU) that controls an IC engine. The concentric camshaft assembly 40 includes intake lobes 46 and exhaust lobes 48, each of which can be arranged on either the inner camshaft 44 or the outer camshaft 42. In some engine design instances, it may prove advantageous to have the outer camshaft 42 configured with the exhaust lobes 48 and the inner camshaft 44 to be configured with the intake lobes 46, however, this arrangement could also be reversed.

Figure 7B:
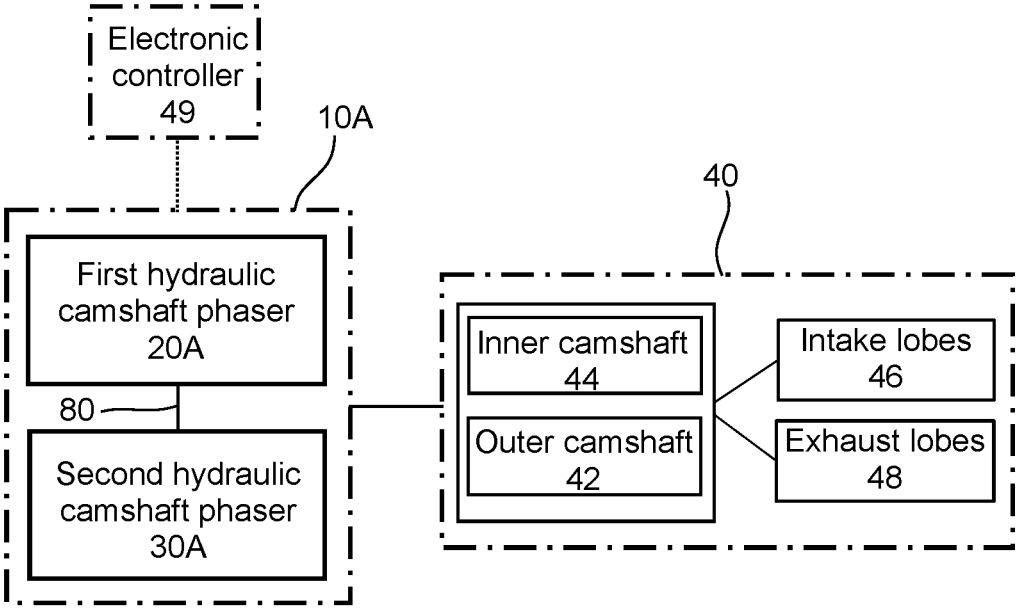
FIG. 7B is a schematic diagram of an example embodiment of a camshaft phaser arrangement with a first and a second hydraulically actuated camshaft phaser.

The first camshaft phaser 20 and second camshaft phaser 30 can be actuated hydraulically with hydraulic fluid such as engine oil, electrically with an electric motor, or by any other actuation means. FIGS. 1 through 4 show a first camshaft phaser 20 that is electrically actuated, and a hydraulically actuated second camshaft phaser 30. It could also be possible to have a hydraulically actuated first camshaft phaser and an electrically actuated second camshaft phaser. Furthermore, it could also be possible to have both camshaft phasers actuated in the same manner. In summary, the first and second camshaft phasers can include at least one of a hydraulic camshaft phaser or an electric camshaft phaser. Referring to FIG. 7B, a schematic diagram of a camshaft phaser arrangement 10A is shown together with an electronic controller 49 and the concentric camshaft assembly 40. The camshaft phaser arrangement 10A includes a first hydraulic camshaft phaser 20A and a second hydraulic camshaft phaser 30A. The first hydraulic camshaft phaser 20A is torsionally coupled to the second hydraulic camshaft phaser 30A by the coupling 80, and both camshaft phasers 20, 30 are electronically controlled by the electronic controller 49. While FIG. 7B's camshaft phaser arrangement 10A shows hydraulically actuated first and second camshaft phasers 20A, 30A, utilizing first and second electrically actuated camshaft phasers could also be possible.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser arrangement configured for a concentric camshaft assembly having inner and outer camshafts, the camshaft phaser arrangement comprising:

a first camshaft phaser configured to be connected to one of the inner or outer camshafts;

a second camshaft phaser configured to be connected to the other of the inner or outer camshafts;

the first camshaft phaser axially adjacent to the second camshaft phaser; and, a coupling arranged to torsionally connect the first camshaft phaser to the second camshaft phaser, the coupling comprising:

at least one flexible connector having:

a first connection to one of the first or second camshaft phaser; and, a second connection to the other of the first or second camshaft phaser; and, the at least one flexible connector configured to provide for radial movement and axial movement between the first camshaft phaser and the second camshaft phaser.

2. The camshaft phaser arrangement of claim 1, wherein the at least one flexible connector deflects laterally to provide for axial movement of at least one of the first camshaft phaser or the second camshaft phaser.

3. The camshaft phaser arrangement of claim 2, wherein the at least one flexible connector is arc-shaped.

4. The camshaft phaser arrangement of claim 3, wherein an angular span of the at least one flexible connector ranges from 1 degree to 359 degrees.

5. The camshaft phaser arrangement of claim 3, wherein the at least one flexible connector is configured with a first aperture at a first end, and a second aperture at a second end.

6. The camshaft phaser arrangement of claim 5, further comprising at least one first fastener received by the first aperture, the at least one first fastener connecting the at least one flexible connector to the one of the first or second camshaft phaser.

7. The camshaft phaser arrangement of claim 5, further comprising at least one second fastener received by the second aperture, the at least one second fastener connecting the at least one flexible connector to the other of the first or second camshaft phaser.

8. The camshaft phaser arrangement of claim 5, wherein the second aperture is a slotted hole.

9. The camshaft phaser arrangement of claim 8, wherein a pathway for the radial movement is defined by the slotted hole.

10. The camshaft phaser arrangement of claim 1, further comprising at least one axial extension having a first end that connects to the at least one flexible connector and a second end that connects to either the first or second camshaft phaser.

11. The camshaft phaser arrangement of claim 10, wherein the second end of the axial extension is connected to the second camshaft phaser, the first camshaft phaser arranged axially outward of the second camshaft phaser.

12. The camshaft phaser arrangement of claim 1, wherein at least one of the first or second camshaft phaser is an electric camshaft phaser or a hydraulic camshaft phaser.

13. The camshaft phaser arrangement of claim 1, wherein a first end of the at least one flexible connector is connected to the first camshaft phaser, and a second end of the at least one flexible connector is connected to the second camshaft phaser, the first camshaft phaser arranged axially outward of the second camshaft phaser.

14. The camshaft phaser arrangement of claim 13, wherein the first end of the at least one flexible connector is connected to a non-phased component of the first camshaft phaser and the second end of the at least one flexible connector is connected to a non-phased component of the second camshaft phaser.

15. The camshaft phaser arrangement of claim 14, wherein the second camshaft phaser includes a drive wheel configured with a power transmission interface.

16. The camshaft phaser arrangement of claim 14, wherein the first camshaft phaser is an electric camshaft phaser, and the second camshaft phaser is a hydraulic camshaft phaser.

17. The camshaft phaser arrangement of claim 16, wherein the first end of the at least one flexible connector is connected to an outer collar of the first camshaft phaser.

18. The camshaft phaser arrangement of claim 16, wherein the first camshaft phaser is configured to be connected to the inner camshaft, and the second camshaft phaser is configured to be connected to the outer camshaft.

19. The camshaft phaser arrangement of claim 16, wherein the second end of the at least one flexible connector is connected to a stator of the second camshaft phaser.

20. A coupling configured to torsionally connect a first camshaft phaser to a second camshaft phaser, the coupling comprising at least one flexible connector with a first end configured to connect with a first camshaft phaser and a second end configured to connect with a second camshaft phaser, the at least one flexible connector configured to provide for radial movement and axial movement between the first camshaft phaser and the second camshaft phaser.

* * * * *